US007937791B2

(12) United States Patent
Meyer et al.

(10) Patent No.: US 7,937,791 B2
(45) Date of Patent: May 10, 2011

(54) PRESSURE RELIEF SURFACE

(75) Inventors: Eric R. Meyer, Greensburg, IN (US); John Alan Bobey, Daniel Island, SC (US); Sohrab Soltani, Charleston, SC (US); Jonathan H. Mueller, Mt. Pleasant, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 12/343,613

(22) Filed: Dec. 24, 2008

(65) Prior Publication Data

US 2009/0119846 A1 May 14, 2009

Related U.S. Application Data

(63) Continuation of application No. 11/324,447, filed on Jan. 3, 2006, now Pat. No. 7,469,436, and a continuation of application No. 11/119,980, filed on May 2, 2005, now abandoned.

(60) Provisional application No. 60/567,215, filed on Apr. 30, 2004, provisional application No. 60/665,241, filed on Mar. 25, 2005, provisional application No. 60/665,141, filed on Mar. 25, 2005, provisional application No. 60/636,252, filed on Dec. 15, 2004, provisional application No. 60/608,013, filed on Sep. 8, 2004.

(51) Int. Cl.
*A47C 27/12* (2006.01)
*A47C 27/10* (2006.01)

(52) U.S. Cl. ..... 5/727; 5/736; 5/713; 5/690

(58) Field of Classification Search ..... 5/727, 724, 5/736, 652, 652.1, 944, 952, 690, 691, 706, 5/710, 713, 654, 655.3, 644, 925, 926
See application file for complete search history.

(56) References Cited

U.S. PATENT DOCUMENTS

| | | | | |
|---|---|---|---|---|
| 779,576 | A | | 1/1905 | Berryman |
| 800,967 | A | | 10/1905 | Young et al. |
| 1,121,277 | A | | 12/1914 | Mitchell |
| 1,332,933 | A | | 3/1920 | Sylvester |
| 1,772,310 | A | | 8/1930 | Hart |
| 1,841,410 | A | * | 1/1932 | Karr ..... 5/500 |
| 2,434,641 | A | * | 1/1948 | Burns ..... 267/117 |
| 3,303,518 | A | | 2/1967 | Ingram |
| 3,492,988 | A | | 2/1970 | De Mare |
| 3,574,873 | A | | 4/1971 | Weinstein |
| 3,605,145 | A | | 9/1971 | Graebe |
| 3,772,717 | A | | 11/1973 | Yuen et al. |

(Continued)

FOREIGN PATENT DOCUMENTS

DE 295 02 025 U1 6/1996

(Continued)

OTHER PUBLICATIONS

A Hill-Rom Solution, Acucair Continuous Airflow System, Hill-Rom Company, Inc., Batesville, IN, 1998.

(Continued)

*Primary Examiner* — Robert G Santos
(74) *Attorney, Agent, or Firm* — Barnes & Thornburg LLP

(57) ABSTRACT

The present invention includes a pressure relief patient support surface. The pressure relief support surface includes a plurality of layers of a three-dimensional networked fiber material positioned inside a cover.

18 Claims, 11 Drawing Sheets

U.S. PATENT DOCUMENTS

| | | | | | |
|---|---|---|---|---|---|
| 3,978,530 | A | | 9/1976 | Amarantos | |
| 4,114,620 | A | | 9/1978 | Moore et al. | |
| 4,316,298 | A | * | 2/1982 | Russo et al. | 5/722 |
| 4,347,633 | A | | 9/1982 | Gammons et al. | |
| 4,448,228 | A | | 5/1984 | Hashimoto et al. | |
| 4,454,615 | A | * | 6/1984 | Whitney | 5/691 |
| 4,477,935 | A | | 10/1984 | Griffin | |
| 4,483,029 | A | | 11/1984 | Paul | |
| 4,525,409 | A | * | 6/1985 | Elesh | 428/193 |
| 4,525,885 | A | | 7/1985 | Hunt | |
| 4,527,298 | A | | 7/1985 | Moulton | |
| 4,541,135 | A | | 9/1985 | Karpov | |
| 4,541,136 | A | * | 9/1985 | Graebe | 5/655.3 |
| 4,542,547 | A | | 9/1985 | Sato | |
| 4,637,083 | A | | 1/1987 | Goodwin | |
| 4,638,519 | A | | 1/1987 | Hess | |
| 4,689,844 | A | | 9/1987 | Alivizatos | |
| 4,694,521 | A | | 9/1987 | Tominaga | |
| 4,698,864 | A | * | 10/1987 | Graebe | 5/654 |
| 4,706,313 | A | | 11/1987 | Murphy | |
| 4,797,962 | A | | 1/1989 | Goode | |
| 4,825,486 | A | | 5/1989 | Kimura et al. | |
| 4,837,877 | A | | 6/1989 | Hamada et al. | |
| 4,839,512 | A | | 6/1989 | Speck | |
| 4,852,195 | A | * | 8/1989 | Schulman | 5/713 |
| 4,864,671 | A | * | 9/1989 | Evans | 5/713 |
| 4,884,304 | A | | 12/1989 | Elkins | |
| 4,907,308 | A | | 3/1990 | Leininger et al. | |
| 4,934,468 | A | | 6/1990 | Koerber, Sr. et al. | |
| 4,944,060 | A | | 7/1990 | Perry et al. | |
| 4,951,335 | A | | 8/1990 | Eady | |
| 4,953,244 | A | | 9/1990 | Koerber, Sr. et al. | |
| 4,993,920 | A | | 2/1991 | Harkleroad et al. | |
| 5,020,176 | A | | 6/1991 | Dotson | |
| 5,029,352 | A | | 7/1991 | Hargest et al. | |
| 5,036,559 | A | | 8/1991 | Hargest | |
| 5,052,068 | A | * | 10/1991 | Graebe | 5/654 |
| 5,060,174 | A | | 10/1991 | Gross | |
| 5,067,189 | A | | 11/1991 | Weedling et al. | |
| 5,097,552 | A | * | 3/1992 | Viesturs | 5/691 |
| 5,101,527 | A | | 4/1992 | Wadsworth et al. | |
| 5,103,518 | A | * | 4/1992 | Gilroy et al. | 5/713 |
| 5,117,518 | A | | 6/1992 | Schild | |
| 5,121,512 | A | | 6/1992 | Kaufmann | |
| 5,127,119 | A | | 7/1992 | Rogers | |
| 5,140,309 | A | | 8/1992 | Gusakov | |
| 5,163,196 | A | | 11/1992 | Graebe et al. | |
| 5,168,589 | A | | 12/1992 | Stroh et al. | |
| 5,180,619 | A | | 1/1993 | Landi et al. | |
| 5,184,122 | A | | 2/1993 | Decious et al. | |
| 5,265,293 | A | * | 11/1993 | Spahn et al. | 5/706 |
| 5,267,364 | A | | 12/1993 | Volk | |
| 5,269,030 | A | | 12/1993 | Pahno et al. | |
| 5,276,432 | A | | 1/1994 | Travis | |
| 5,289,030 | A | | 2/1994 | Yamazaki et al. | |
| 5,316,041 | A | | 5/1994 | Ramacier, Jr. et al. | |
| 5,325,551 | A | | 7/1994 | Tappel et al. | |
| 5,350,417 | A | | 9/1994 | Augustine | |
| 5,364,162 | A | | 11/1994 | Bar et al. | |
| 5,373,595 | A | | 12/1994 | Johnson et al. | |
| 5,379,471 | A | | 1/1995 | Holdredge | |
| 5,402,542 | A | | 4/1995 | Viard | |
| 5,412,821 | A | | 5/1995 | Wilkinson | |
| 5,444,881 | A | | 8/1995 | Landi et al. | |
| 5,448,788 | A | | 9/1995 | Wu | |
| 5,483,709 | A | | 1/1996 | Foster et al. | |
| 5,483,711 | A | | 1/1996 | Hargest et al. | |
| 5,539,942 | A | | 7/1996 | Melou | |
| 5,542,136 | A | | 8/1996 | Tappel | |
| 5,561,873 | A | | 10/1996 | Weedling | |
| 5,561,875 | A | | 10/1996 | Graebe | |
| 5,564,142 | A | | 10/1996 | Liu | |
| 5,586,346 | A | | 12/1996 | Stacy et al. | |
| 5,596,781 | A | | 1/1997 | Graebe | |
| 5,611,096 | A | | 3/1997 | Bartlett et al. | |
| 5,623,736 | A | | 4/1997 | Soltani et al. | |
| 5,630,238 | A | | 5/1997 | Weismiller et al. | |
| 5,634,225 | A | | 6/1997 | Miller, Sr. et al. | |
| D386,035 | S | | 11/1997 | Matsler et al. | |
| 5,689,845 | A | | 11/1997 | Sobieralski | |
| 5,692,256 | A | | 12/1997 | Kramer et al. | |
| 5,699,570 | A | | 12/1997 | Wilkinson et al. | |
| 5,715,548 | A | | 2/1998 | Weismiller et al. | |
| 5,731,062 | A | | 3/1998 | Kim et al. | |
| 5,755,000 | A | | 5/1998 | Thompson | |
| 5,785,716 | A | | 7/1998 | Bayron et al. | |
| 5,787,531 | A | | 8/1998 | Pepe | |
| 5,794,288 | A | | 8/1998 | Soltani et al. | |
| 5,815,864 | A | | 10/1998 | Sloop | |
| 5,815,865 | A | | 10/1998 | Washburn et al. | |
| 5,829,081 | A | | 11/1998 | Pearce | |
| 5,836,027 | A | * | 11/1998 | Leventhal et al. | 5/706 |
| 5,840,400 | A | | 11/1998 | Landi et al. | |
| 5,845,352 | A | | 12/1998 | Matsler et al. | |
| 5,873,137 | A | | 2/1999 | Yavets-Chen | |
| D407,353 | S | | 3/1999 | Bar et al. | |
| D408,767 | S | | 4/1999 | Bar et al. | |
| 5,917,180 | A | | 6/1999 | Reimer et al. | |
| 5,926,884 | A | | 7/1999 | Biggie et al. | |
| D412,685 | S | | 8/1999 | Bar et al. | |
| D413,085 | S | | 8/1999 | Bar et al. | |
| 5,934,280 | A | | 8/1999 | Viard et al. | |
| D413,841 | S | | 9/1999 | Bar et al. | |
| 5,954,402 | A | | 9/1999 | McInturff | |
| D415,567 | S | | 10/1999 | Bar | |
| D415,834 | S | | 10/1999 | Bar | |
| 5,966,763 | A | | 10/1999 | Thomas et al. | |
| 5,970,789 | A | | 10/1999 | Meyer et al. | |
| D416,326 | S | | 11/1999 | Bar | |
| 5,984,418 | A | | 11/1999 | McInturff | |
| 5,989,285 | A | | 11/1999 | De Vilbiss et al. | |
| 5,991,949 | A | | 11/1999 | Miller, Sr. et al. | |
| 6,014,346 | A | | 1/2000 | Malone | |
| 6,036,660 | A | | 3/2000 | Toms | |
| 6,049,927 | A | | 4/2000 | Thomas et al. | |
| 6,073,289 | A | | 6/2000 | Bolden et al. | |
| 6,076,208 | A | | 6/2000 | Heimbrock et al. | |
| 6,095,611 | A | | 8/2000 | Bar et al. | |
| 6,145,142 | A | | 11/2000 | Rechin et al. | |
| 6,154,907 | A | | 12/2000 | Cinquin | |
| 6,165,142 | A | | 12/2000 | Bar | |
| 6,175,752 | B1 | | 1/2001 | Say et al. | |
| 6,182,316 | B1 | | 2/2001 | Thomas et al. | |
| D439,098 | S | | 3/2001 | Matsler et al. | |
| 6,212,718 | B1 | | 4/2001 | Stolpmann et al. | |
| 6,240,584 | B1 | | 6/2001 | Perez et al. | |
| 6,269,504 | B1 | | 8/2001 | Romano et al. | |
| 6,272,707 | B1 | | 8/2001 | Robrecht et al. | |
| 6,320,510 | B2 | | 11/2001 | Menkedick et al. | |
| 6,378,152 | B1 | | 4/2002 | Washburn et al. | |
| 6,401,283 | B2 | | 6/2002 | Thomas et al. | |
| D463,701 | S | | 10/2002 | Gorcherding et al. | |
| 6,474,743 | B1 | | 11/2002 | Harker et al. | |
| 6,487,739 | B1 | | 12/2002 | Harker | |
| 6,499,167 | B1 | | 12/2002 | Ellis et al. | |
| 6,560,803 | B2 | | 5/2003 | Zur | |
| 6,560,804 | B2 | | 5/2003 | Wise et al. | |
| 6,564,410 | B2 | | 5/2003 | Graebe et al. | |
| 6,568,273 | B2 | | 5/2003 | Reimer | |
| 6,582,456 | B1 | | 6/2003 | Hand et al. | |
| 6,593,588 | B1 | | 7/2003 | Reimer | |
| 6,623,080 | B2 | | 9/2003 | Clapper | |
| 6,646,556 | B1 | | 11/2003 | Smith et al. | |
| 6,687,936 | B2 | | 2/2004 | Graebe et al. | |
| 6,687,937 | B2 | | 2/2004 | Harker | |
| 6,687,987 | B2 | | 2/2004 | Mayer et al. | |
| 6,701,556 | B2 | | 3/2004 | Romano et al. | |
| 6,730,115 | B1 | | 5/2004 | Heaton | |
| 6,735,799 | B1 | | 5/2004 | Ellis et al. | |
| 6,735,800 | B1 | | 5/2004 | Salvatini et al. | |
| 6,735,801 | B2 | | 5/2004 | Henley et al. | |
| 6,760,939 | B2 | | 7/2004 | Ellis et al. | |
| 6,782,574 | B2 | | 8/2004 | Totton et al. | |
| 6,848,135 | B1 | | 2/2005 | Kohlman | |
| 6,877,178 | B2 | | 4/2005 | Chapman et al. | |
| 6,901,617 | B2 | * | 6/2005 | Sprouse et al. | 5/654 |
| 7,191,480 | B2 | | 3/2007 | Romano et al. | |

| | | | | |
|---|---|---|---|---|
| 7,191,482 | B2 | 3/2007 | Romano et al. | |
| 7,350,251 | B2 | 4/2008 | Fraser et al. | |
| 7,409,735 | B2 | 8/2008 | Kramer et al. | |
| 7,469,436 | B2 | 12/2008 | Meyer et al. | |
| 7,480,953 | B2 * | 1/2009 | Romano et al. | 5/714 |
| 7,557,718 | B2 * | 7/2009 | Petrosenko et al. | 340/573.1 |
| 7,617,555 | B2 * | 11/2009 | Romano et al. | 5/714 |
| 7,657,956 | B2 * | 2/2010 | Stacy et al. | 5/713 |
| 7,681,265 | B2 * | 3/2010 | Fraser | 5/654 |
| 7,698,765 | B2 * | 4/2010 | Bobey et al. | 5/713 |
| 7,883,478 | B2 * | 2/2011 | Skinner et al. | 600/595 |
| 2001/0054200 | A1 | 12/2001 | Romano et al. | |
| 2002/0066143 | A1 | 6/2002 | Graebe et al. | |
| 2003/0030319 | A1 | 2/2003 | Clapper | |
| 2003/0205920 | A1 * | 11/2003 | Sprouse et al. | 297/219.1 |
| 2004/0160112 | A1 * | 8/2004 | Clapper | 297/452.41 |
| 2004/0168255 | A1 | 9/2004 | Romano et al. | |
| 2004/0237203 | A1 | 12/2004 | Romano et al. | |
| 2006/0080778 | A1 | 4/2006 | Chambers | |
| 2006/0112489 | A1 | 6/2006 | Bobey et al. | |
| 2006/0168736 | A1 | 8/2006 | Meyer et al. | |
| 2007/0163052 | A1 | 7/2007 | Romano et al. | |
| 2008/0028533 | A1 | 2/2008 | Stacy et al. | |
| 2008/0196166 | A1 | 8/2008 | Fraser | |
| 2009/0119846 | A1 * | 5/2009 | Meyer et al. | 5/709 |
| 2009/0217460 | A1 * | 9/2009 | Bobey et al. | 5/709 |
| 2010/0095461 | A1 * | 4/2010 | Romano et al. | 5/710 |
| 2010/0095462 | A1 * | 4/2010 | Bobey et al. | 5/713 |
| 2010/0132116 | A1 * | 6/2010 | Stacy et al. | 5/423 |

FOREIGN PATENT DOCUMENTS

| | | | |
|---|---|---|---|
| DE | 103 16 162 | | 10/2004 |
| DE | 103 33 742 | A1 | 2/2005 |
| FR | 2 596 950 | | 10/1987 |
| FR | 2 814 062 | | 3/2002 |
| GB | 159299 | | 2/1921 |
| JP | 2007-159981 | | 6/2007 |
| WO | WO 94/09686 | | 5/1994 |
| WO | WO 96/33641 | | 10/1996 |
| WO | WO 03/041538 | A1 | 5/2003 |
| WO | WO 2005/013878 | | 2/2005 |

OTHER PUBLICATIONS

Hill-Rom PrimeAire® ARS Pressure Relief Mattress, Hill-Rom Company, Inc., Batesville, IN, 2004.

Gaymar Soft-Care Plus © Companion System, Gaymar Industries, Inc., 1994.

First Step, Mattress Replacement System, KCI, San Antonio, TX, 1991.

Impression Pressure Relief Therapy, KCI, date unknown.

Lumex Akro Tech 4000, Lumex, date unknown.

MicroAIRO 1000, GSI Medical Systems, Carmel, NY, 1989.

PRO 2000 MRS, Pneu-Care Series, Cardio Systems, Dallas, TX, date unknown.

Prodigy Mattress Crown Therapeutics, Inc., date unknown.

Roho Dry Flotation Isolette see roho.com/medical/isolette.jsp., date unknown.

Roho series Crown Therapeutic, Inc., see woundheal.com, date unknown.

Tytex Group AirX #D Spacer Fabric see tytex.cms. digitalis.dk, dte unknown.

Renaissance™ Therapeutic Mattress Replacement System, Pegasus Airwave, Inc., date unknown.

Air Flow 5000 Mattress Replacement System, Atlantis Medical, Milltown, NJ, date unknown.

Apropros, CRS-8500, National Patient Care Systems, date unknown.

ASAP II Therapy System, DynaMedics Corporation, London, ON, Canada Mar. 1995.

Bazooka, Innovative Medical System, Manchester, NH, 1995.

DFS® Homecare Advanced Dynamic Flotation System, HNE Healthcare, Manalapan, NJ, date unknown.

Economic Relief, Bio Therapy © Plus, Sunrise Medical Bio Clinic, Ontario, CA, date unknown.

Office Action mailed from the United States Patent and Trademark Office on Nov. 29, 2007, for U.S. Appl. No. 11/120,080 (10 pages).

Office Action mailed from the United States Patent and Trademark Office on May 22, 2007 for U.S. Appl. No. 11/324,520 (14 pages).

Office Action mailed from the United States Patent and Trademark Office on Dec. 21, 2006 for U.S. Appl. No. 11/324,520 and accompanying PTO-892 (38pages).

Office Action mailed from the United States Patent and Trademark Office on Jul. 6, 2006 for U.S. Appl. No. 11/324,520 and accompanying PTO-892 (10 pages).

International Search Report and Written Opinion for PCT/US06/26787, dated Mar. 6, 2008 (8 pages).

Office Action mailed from the United States Patent and Trademark Office on Sep. 18, 2008 for U.S. Appl. No. 11/324,420, and accompanying PTO-892 (13 pages).

* cited by examiner

PRESSURE RELIEF SURFACE

CROSS-REFERENCE TO RELATED APPLICATIONS

This application is a continuation of U.S. patent application Ser. No. 11,324,447, filed Jan. 3, 2006, which is a continuation of U.S. patent application Ser. No. 11/119,980 to Meyer et al., entitled PRESSURE RELIEF, filed May 2, 2005, which claims the benefit of U.S. Provisional Patent Application Ser. No. 60/567,215 to Balaton et al., entitled PRESSURE RELIEF SUPPORT SURFACE, filed Apr. 30, 2004, and U.S. Provisional Patent Application Ser. No. 60/665,241 of Hopkins et al., entitled THERMOREGULATING DEVICE WITH SUPPORT CELLS, filed Mar. 25, 2005, and U.S. Provisional Patent Application Ser. No. 60/665,141 of Hopkins et al., entitled THERMOREGULATING DEVICE, filed Mar. 25, 2005, and U.S. Provisional Patent Application Ser. No. 60/636,252 of Chambers et al., entitled QUICK CONNECTOR FOR MULTIMEDIA, filed Dec. 15, 2004, and U.S. Provisional Patent Application Ser. No. 60/608,013 of Branson, entitled ROTATION SENSOR FOR A MATTRESS, filed Sep. 8, 2004, all of which are incorporated herein by this reference in their entirety. The inventors of the above-referenced applications and the inventors of the present invention are obligated to assign their rights in the applications to the same assignee.

The present application is also related to U.S. patent application Ser. No. 11/120,080, entitled PATIENT SUPPORT, U.S. patent application Ser. No. 11/119,991, entitled PATIENT SUPPORT HAVING REAL TIME PRESSURE CONTROL, and U.S. patent application Ser. No. 11/119,635, entitled LACK OF PATIENT MOVEMENT AND METHOD, all of which were filed on May 2, 2005, and all of which are incorporated herein by this reference.

BACKGROUND OF THE DISCLOSURE

The present disclosure relates to a device for supporting a patient, such as a mattress. In particular, the present disclosure relates to patient supports appropriate for use in hospitals, acute care facilities, and other patient care environments. Certain embodiments disclosed herein relate to pressure relief support surfaces.

SUMMARY OF THE DISCLOSURE

In one illustrated embodiment, a patient support is provided that has a cover defining an interior region. The cover includes a top surface and a bottom surface. First and second layers of a three-dimensional material and a plurality of vertical can bladders are positioned in the interior region. The plurality of vertical can bladders is positioned below the second layer. The three-dimensional material comprises a network of thermoplastic fibers. The network comprises a plurality of spaced-apart dome-shaped projections. The first layer is positioned with the dome-shaped projections projecting upwardly toward the top surface of the cover. The second layer is positioned below the first layer. The dome-shaped projections of the second layer project downwardly away from the first layer toward the bottom surface of the cover.

In another embodiment, a patient support is provided that has an outer cover defining an interior region. A support layer and a plurality of vertical can bladders are positioned in the interior region. The plurality of vertical can bladders positioned below the support layer. The support layer includes a support cover, an upper section, and a lower section. The upper and lower sections are formed from a three-dimensional material comprising a network of thermoplastic fibers.

In another embodiment, a patient support is provided that has a cover defining an interior region. A body and a top layer are positioned in the interior region. The body includes a plurality of inflatable zones, each zone including a plurality of vertical can bladders. The top layer is positioned above the body in the interior region. The top layer includes at least one layer of an air-permeable three-dimensional material. The three-dimensional material comprises a network of thermoplastic fibers three-dimensional material.

In yet another embodiment, a patient support is provided that has a cover defining an interior region. A first layer and a second layer are located in the interior region. The second layer is positioned below the first layer. The first layer includes an upper section and a lower section. Each of the upper and lower sections includes at least one layer of an air-permeable three-dimensional material. The three-dimensional material comprises a network of thermoplastic fibers. The second layer includes head, seat, and foot sections. At least one of the head, seat, and foot sections include vertical inflatable bladders.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

Aspects of the present invention are more particularly described below with reference to the following figures, which illustrate exemplary embodiments of the present invention.

DETAILED DESCRIPTION OF ILLUSTRATED EMBODIMENTS

The support surface of the present invention includes a variety of features designed to accommodate a variety of beds and frames and meet the needs of many different types of patients, including bariatric patients. The various aspects of the novel pressure-relief support surface are described in detail below.

Figure 1:
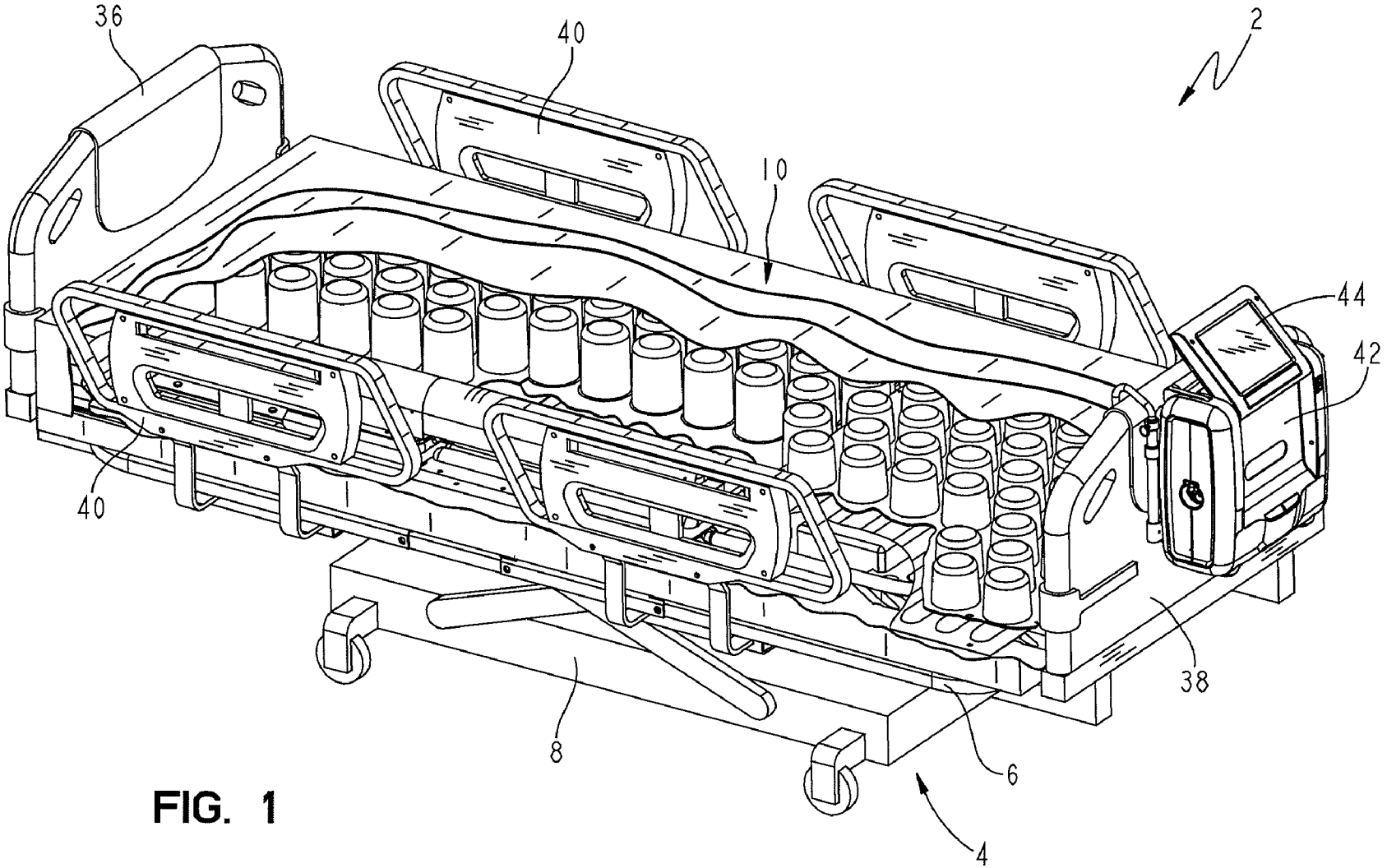
FIG. 1 is a perspective view of a patient support positioned on an exemplary hospital bed, with a portion of the patient support being cut away to show interior components of the patient support.

FIG. 1 shows an embodiment of a patient support 10 in accordance with the present invention. Patient support 10 is positioned on an exemplary bed 2. Bed 2, as illustrated, is a hospital bed including a frame 4, a headboard 36, a footboard 38, and a plurality of siderails 40.

Frame 4 of the exemplary bed 2 generally includes a deck 6 supported by a base 8. Deck 6 includes one or more deck sections (not shown), some or all of which may be articulating sections, i.e., pivotable with respect to base 8. In general, patient support 10 is configured to be supported by deck 6.

Patient support 10 has an associated control unit 42, which controls inflation and deflation of certain internal components of patient support 10, among other things. Control unit 42 includes a user interface 44, which enables caregivers and service providers to configure patient support 10 according to the needs of a particular patient. For example, support characteristics of patient support 10 may be adjusted according to the size, weight, position, or activity of the patient.

User interface 44 also enables patient support 10 to be adapted to different bed configurations. For example, deck 6 may be a flat deck or a step or recessed deck. A caregiver may select the appropriate deck configuration via user interface 44.

Figure 2:
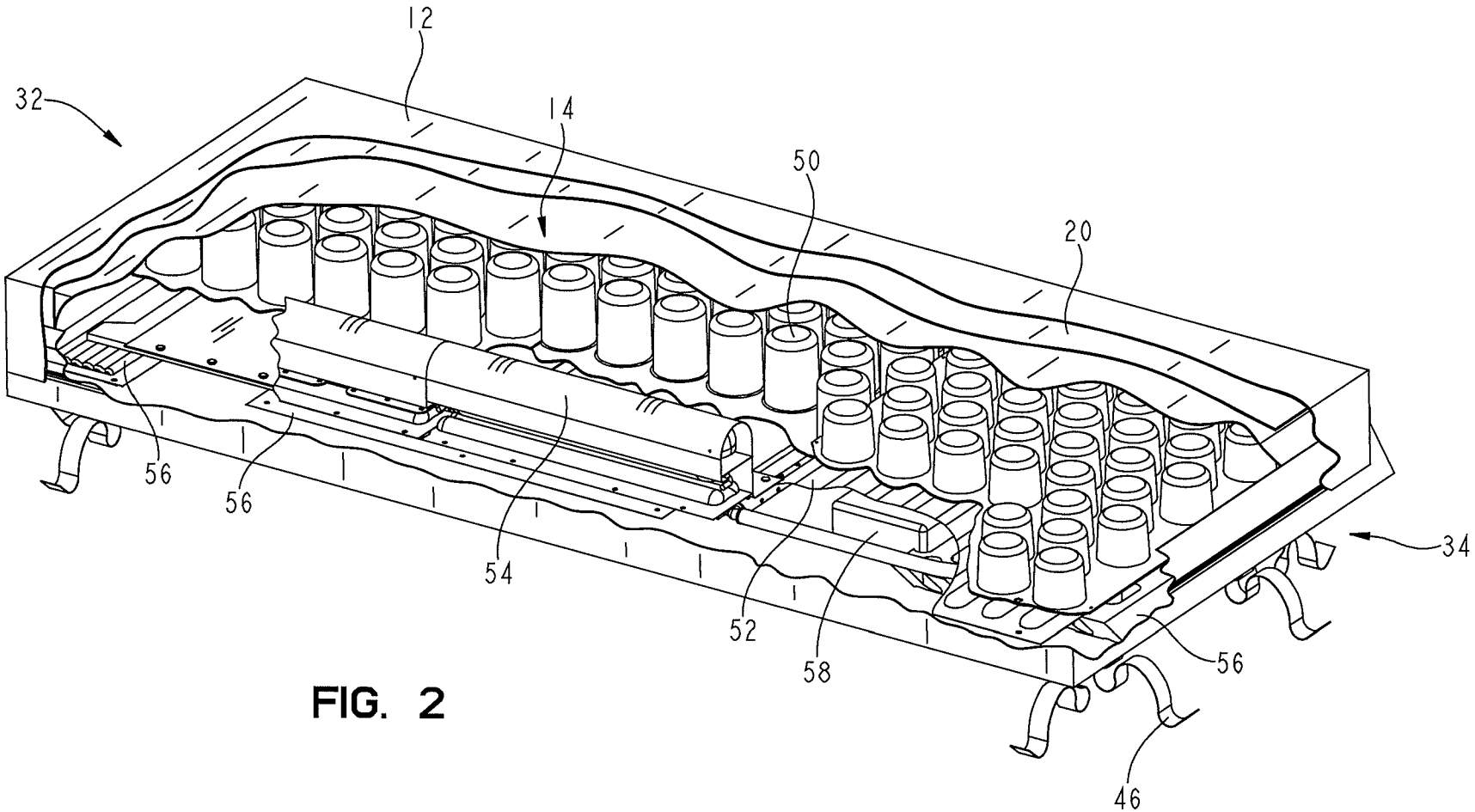
FIG. 2 is a perspective view of a patient support, with a portion being cut away to show interior components of the patient support.

Referring now to FIG. 2, patient support 10 has a head end 32 generally configured to support a patient's head and/or upper body region, and a foot end 34 generally configured to support a patient's feet and/or lower body region. Patient support 10 includes a cover 12 which defines an interior region 14. In the illustrated embodiment, interior region 14 includes a first layer 20, a second layer 50, and a third layer 52. However, it will be understood by those skilled in the art that other embodiments of the present invention may not include all three of these layers, or may include additional layers, without departing from the scope of the present invention.

In the illustrated embodiment, first layer 20 includes a support material, second layer 50 includes a plurality of vertically-oriented inflatable bladders located underneath the first layer 20, and third layer 52 includes a plurality of pressure sensors located underneath the vertical bladders of second layer 50, as more particularly described below.

Also located within interior region 14 are a plurality of bolsters 54, one or more filler portions 56, and a pneumatic valve control box 58. A fire-resistant material (not shown) may also be included in the interior region 14.

Patient support 10 may be coupled to deck 6 by one or more couplers 46. Illustratively, couplers 46 are conventional woven or knit or fabric straps including a D-ring assembly or Velcro®-brand strip or similar fastener. It will be understood by those skilled in the art that other suitable couplers, such as buttons, snaps, or tethers may also be used equally as well.

Figure 3:
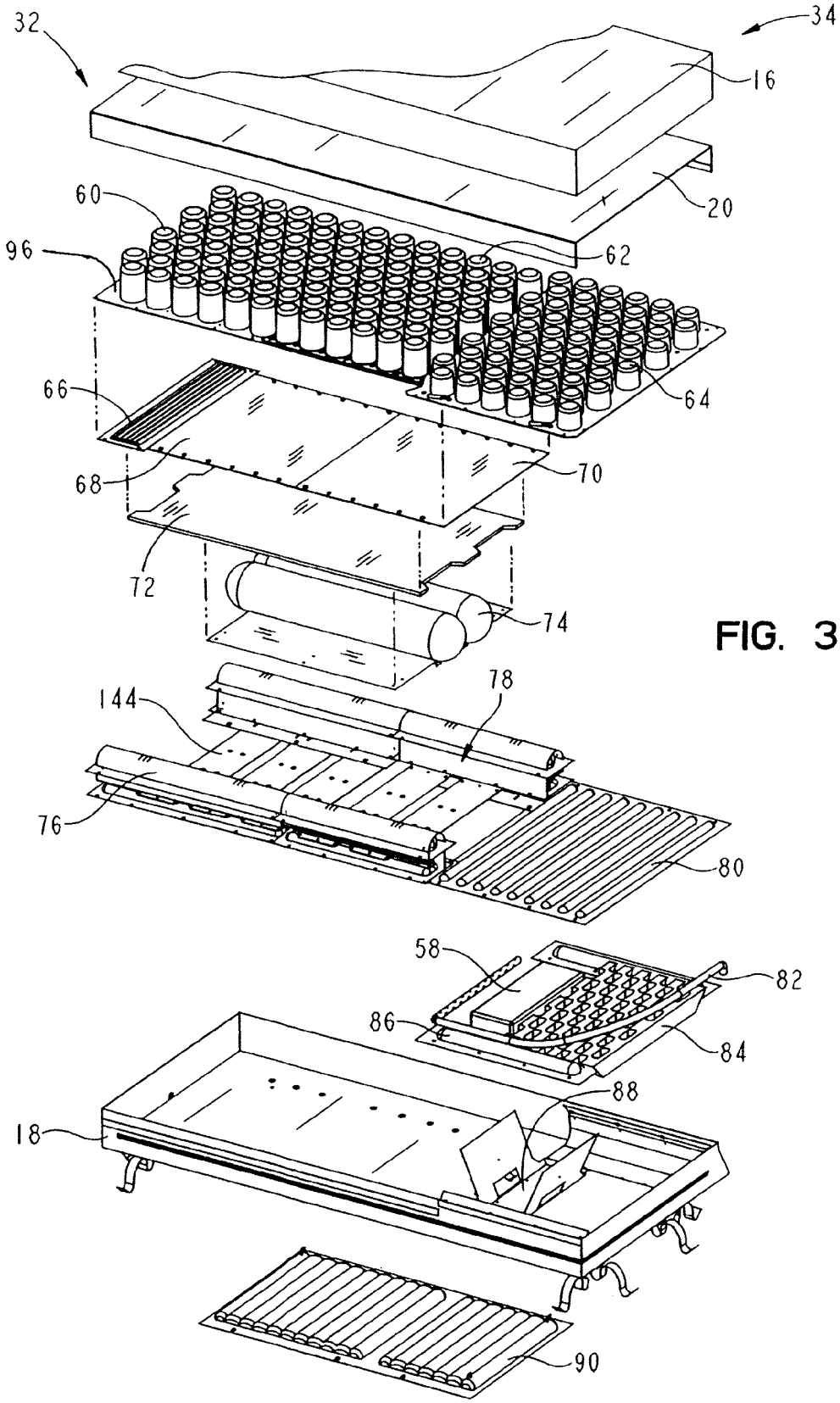
FIG. 3 is an exploded view of components of the illustrated embodiment of a patient support.

Components of one embodiment of a patient support in accordance with the present invention are shown in exploded view in FIG. 3. This embodiment of patient support 10 includes a top cover portion 16 and a bottom cover portion 18. Top cover portion 16 and bottom cover portion 18 couple together by conventional means (such as zipper, Velcro® strips, snaps, buttons, or other suitable fastener) to form cover 12, which defines interior region 14. While a plurality of layers and/or components are illustrated within interior region 14, it will be understood by those of skill in the art that the present invention does not necessarily require all of the illustrated components.

A first support layer 20 is located below top cover portion 16 in interior region 14. First support layer 20 includes one or more materials, structures, or fabrics suitable for supporting a patient, such as foam, inflatable bladders, or three-dimensional material. Suitable three-dimensional materials include Spacenet, Tytex, and/or similar materials. One embodiment of a suitable three dimensional material for support layer 20 is shown in FIG. 4, described below.

Returning to FIG. 3, a second support layer 50 including one or more inflatable bladder assemblies coupled to a base 96, is located underneath the first support layer 20. The illustrated embodiment of the second support layer 50 includes first, second and third bladder assemblies, namely, a head section bladder assembly 60, a seat section bladder assembly 62, and a foot section bladder assembly 64. However, it will be understood by those skilled in the art that other embodiments include only one bladder assembly extending from head end 32 to foot end 34, or other arrangements of multiple bladder assemblies, for example, including an additional thigh section bladder assembly. In the illustrated embodiment, the base 96 is a plastic sheet.

"Different sections of the support surface may have differently sized vertical air cells within them. For example, in certain embodiments, the vertical air cells used in the head and back sections of the support surface have a larger height than those used in the foot section. In certain of those embodiments, the vertical air cells of the head and back sections have a height in the range of 5-8 inches and the vertical air cells of the foot section have a height in the range of 3-5 inches. In one particular embodiment, the vertical air cells of the head and back sections are about 6-7 inches high and the vertical air cells of the foot section are about 4-4.5 inches high."

A pressure-sensing layer 69 illustratively including first and second sensor pads, namely a head sensor pad 68 and a seat sensor pad 70, is positioned underneath bladder assemblies 60, 62, 64. Head sensor pad 68 is generally aligned underneath head section bladder assembly 60, and seat sensor pad 70 is generally aligned underneath seat section bladder assembly 62, as shown. In other embodiments, a single sensor pad or additional sensor pads, for example, located underneath foot section bladder assembly 64, and/or different alignments of the sensor pads, are provided. Additional details of pressure sensing layer 69 can be found in U.S. patent application title PATIENT SUPPORT HAVING REAL TIME PRESSURE CONTROL, application Ser. No. 11/119,635, which is expressly incorporated by reference herein.

In the illustrated embodiment, a turn-assist cushion or turning bladder or rotational bladder 74 is located below sensor pads 68, 70. The exemplary turn-assist cushion 74 shown in FIG. 3 includes a pair of inflatable bladders. Another suitable rotational bladder is a bellows-shaped bladder. Another suitable turn-assist cushion is disclosed in, for example, U.S. Pat. No. 6,499,167 to Ellis, et al., which patent is owned by the assignee of the present invention and incorporated herein by this reference. One of ordinary skill in the art will readily appreciate that turn-assist cushions 74 are not necessarily a required element of the present invention.

A plurality of other support components 66, 72, 76, 78, 80, 84, 86, 90 are also provided in the embodiment of FIG. 3. One or more of these support components are provided to enable patient support 10 to be used in connection with a variety of different bed frames, in particular, a variety of bed frames having different deck configurations. One or more of these support components may be selectively added to or removed from patient support 10 in order to conform patient support 10 to a particular deck configuration, such as a step or recessed deck or a flat deck.

The support components illustrated in FIG. 3 are made of foam, inflatable bladders, three-dimensional material, other suitable support material, or a combination of these. For example, as illustrated, head filler 66 includes a plurality of foam ribs extending transversely across patient support 10. Filler portion 72 includes a foam layer positioned substantially underneath the sensor pads 68, 70 and extending transversely across the patient support 10.

Head bolster assembly 76, seat bolster assembly 78, and foot section bolster assembly 86 each include longitudinally-oriented inflatable bladders spaced apart by coupler plates 144.

As illustrated, first foot filler portion 80 includes a plurality of inflatable bladders extending transversely across patient support 10, and second foot filler portion 84 includes a foam member, illustratively with portions cut out to allow for retractability of the foot section or for other reasons. Deck filler portion 90 includes a plurality of transversely-extending inflatable bladders. As illustrated, deck filler portion 90 includes two bladder sections, and is located outside of cover 12. However, one of ordinary skill in the art will recognize that deck filler portion 90 may include one or more bladder regions, or may be located within interior region 14, without departing from the scope of the present invention.

Also provided in the illustrated embodiment are a pneumatic valve box 58 and an air supply tube assembly 82. Receptacle 88 is sized to house pneumatic valve box 58. In the illustrated embodiment, receptacle 88 is coupled to bottom cover portion 18 by Velcro® strips.

In the illustrated embodiment, support layer 20 includes a breathable or air permeable material which provides cushioning or support for a patient positioned thereon and allows for circulation of air underneath a patient. The circulated air may be at ambient temperature, or may be cooled or warmed in order to achieve desired therapeutic effects.

Also in the illustrated embodiment, support layer 20 includes or is enclosed in a low friction material (such as spandex, nylon, or similar material) enclosure that allows support layer 20 to move with movement of a patient on patient support 10, in order to reduce shear forces or for other reasons. Additional details relating to patient support 10 are found in U.S. patent application titled PATIENT SUPPORT, U.S. patent application Ser. No. 11/120,080, which is expressly incorporated by reference herein.

A first embodiment of the pressure-relief support surface of the present invention includes a cover and a plurality of layers of a three-dimensional material located within an interior region of the cover.

The three-dimensional material is an air permeable network of fibers that has resilient, spring-like qualities, and allows for internal air circulation, for example, to provide cooling to aid in wound healing and minimize patient perspiration. The circulated air could be air that is above, at, or below ambient temperature in order to warm the patient if the patient is cool and vice versa, or achieve other desired therapeutic effects.

The three-dimensional material also has low-friction characteristics; that is, it is able to move or slide along with the movement of the patient on the support surface to reduce shear forces.

In certain embodiments, the three-dimensional material is a collapsible, slidable or lockable material. In general, the three-dimensional material is made of a woven, knitted, or non-woven fabric which comprises thermoplastic fibers or monofilaments. In one embodiment, the three-dimensional material is a breathable monofilament polyester mesh fabric that is formed into various three-dimensional patterns after weaving such as is manufactured by Freudenberg & Co. of Weinheim, Germany.

In other embodiments, a three-dimensional knit material, such as is manufactured by Tytex Group (Tytex Inc. of Rhode Island, U.S.A.) is used in place of or in addition to the SpaceNet or other three-dimensional material.

FIGS. 4*a*-4*f* illustrate alternative embodiments of a support surface including a three-dimensional material located within an interior region of a cover. As particularly shown in FIGS. 4*a*-4*f*, the illustrated three-dimensional material generally includes a plurality of alternating dome- or semicircular-shaped projections and depressions, or peaks and troughs.

Specific dimensions of these peaks and troughs may be mentioned in connection with particular embodiments discussed below, but it is understood that these dimensions are not so limited. Any type of three dimensional material, with peaks and troughs of any size may be used. In certain embodiments, these dimensions are adjusted to, for example, achieve particular support characteristics.

Figure 4A:
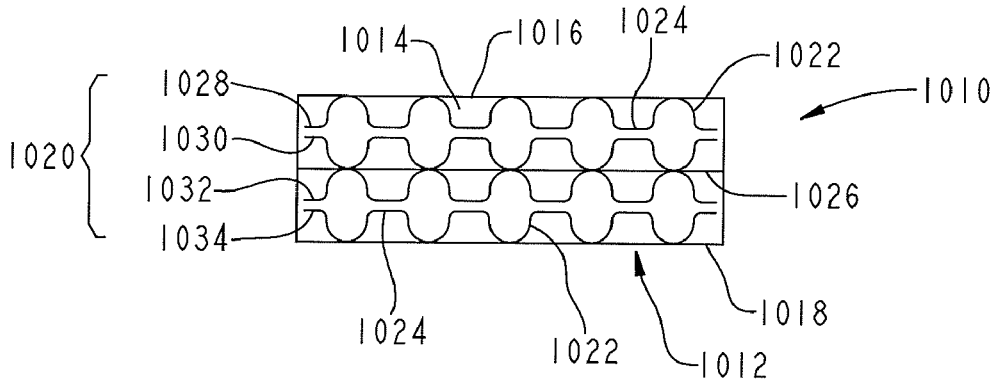
FIGS. 4*a*-4*f* illustrate side views of various configurations of a three-dimensional material.

FIG. 4*a* is a side view of a first embodiment of a support surface 1010 including the three-dimensional material located inside a cover 1012. As shown in FIG. 4*a*, the cover 1012 defines an interior region 1014, which contains a plurality of layers of three-dimensional material 1020. As illustrated in FIG. 4*a*, there are four individual layers or strips 1028, 1030, 1032, 1034 of the three-dimensional material provided within the interior region 1014 of the cover 1012. Each individual layer of three-dimensional material includes a plurality of peaks or substantially dome-shaped projections 1022 and troughs or depressions 1024.

As illustrated in FIG. 4*a*, there are two layers 1028, 1030 of three-dimensional material stacked "back-to-back", with the dome-shaped projections or peaks facing in opposite directions, located above a separator material 1026, and two layers 1032, 1034 of the three-dimensional material stacked or positioned back-to-back below the separator material 1026. The dome-shaped projections or peaks 1022 and depressions or troughs 1024, respectively, are substantially aligned. The separator material 1026 is comprised of the same material used for the cover 1012, or another suitable divider material. In the illustrated embodiments, the separator material 1026 is breathable or air permeable. Alternatively or in addition, the separator material 1026 provides support for the layers 1028, 1030. In alternative embodiments, no separator material 1026 is used.

The cover 1012 has a top surface 1016 and a bottom surface 1018. A first sublayer 1028 of the three-dimensional material has dome-shaped projections 1022 projecting upwardly and located adjacent the top surface 1016 of the cover within the interior region 1014. A second sublayer 1030 of the three-dimensional material has dome-shaped projections 1022 facing downwardly and located adjacent the separator material 1026. A third sublayer 1032 of the three-dimensional material has dome-shaped projections 1022 facing upwardly toward and adjacent to the separator material 1026. A fourth sublayer 1034 of the three-dimensional material has dome-shaped projections 1022 projecting downwardly toward the bottom surface 1018 of the cover 1012.

Figure 4B:
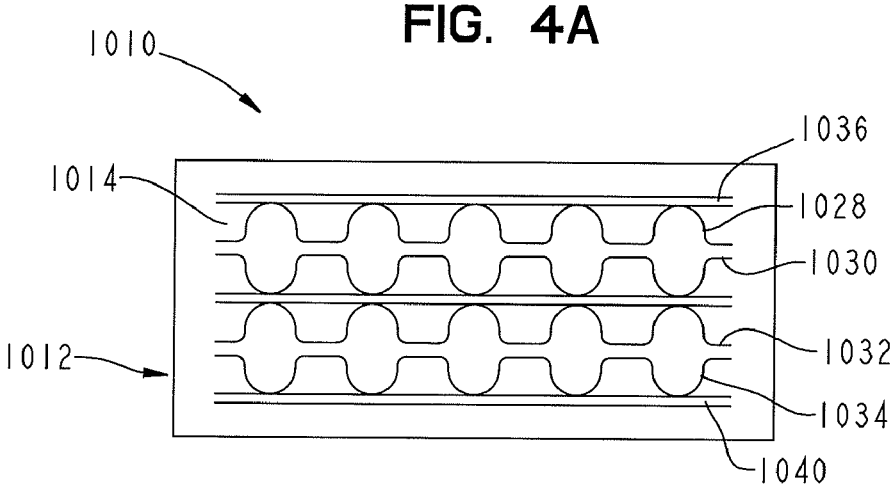

FIG. 4*b* illustrates an alternative embodiment of the support surface 1010, which is similar to the embodiment shown in FIG. 4*a*, except that within the interior region 1014 of the cover 1012, there is located three layers of a three-dimensional spacer material 1036, 1038, 1040. The first layer of spacer material 1036 is located above the first sublayer 1028 of three-dimensional fabric. The second layer 1038 of three-dimensional spacer material is located between the second and third sublayers 1030, 1032 of three-dimensional material. The third layer 1040 of three-dimensional spacer fabric is located below or underneath the fourth sublayer 1034 of three-dimensional material.

The layers of three-dimensional spacer material 1036, 1038, 1040 are made of an air permeable spacer fabric 1041. In general, the three-dimensional spacer fabric is a lightweight material that also has a cushioning effect and is breathable and able to transfer moisture. In the illustrated embodiments, the spacer fabric is a three-dimensional knit spacer fabric manufactured by Tytex Group. In one embodiment, the three-dimensional spacer fabric is latex-free. FIG. 4*g* is a side view of one form of spacer fabric 1041.

Figure 4C:
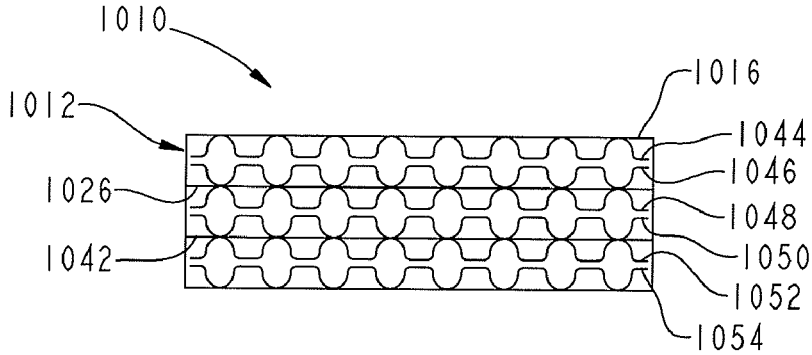

FIG. 4*c* shows another alternative embodiment of the support surface 1010, which is similar to the embodiment shown in FIG. 4*a*, except that it includes a second layer of a separator material 1042 and two additional individual layers 1052, 1054 of the three-dimensional material. As shown in FIG. 4*c*, first and second sublayers 1044, 1046 of the three-dimensional material are located above the first separator material 1026. Second and third sublayers 1048, 1050 of the three-dimensional material are located between the first separator material 1026 and the second separator material 1042. The third and fourth individual layers 1052, 1054 of three-dimensional material are located between the second separator material 1042 and the bottom surface 1018 of the cover 1012.

The layers of separator material 1026, 1042 are comprised of the same material as is used for the cover 1012, a three-dimensional spacer fabric as described above, or other similar suitable material.

Figure 4D:
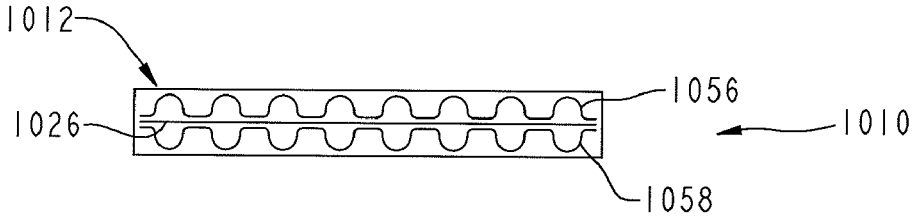

FIG. 4*d* shows yet another alternative embodiment of the support surface 1010. In FIG. 4*d*, a first individual layer 1056 of three-dimensional material is separated by a separator material 1026 from a second individual layer 1058 of three-dimensional material, within the cover 1012, so that there is only one individual layer of three-dimensional material on either side of the separator material 1026. The peaks or dome-shaped projections and troughs or depressions of the layers 1056 and 1058 are substantially aligned as discussed above.

Figure 4E:
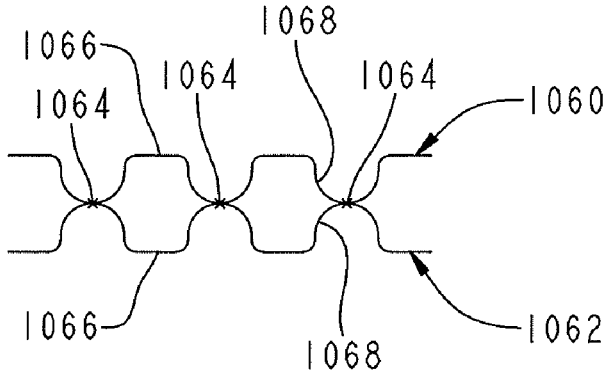

FIG. 4*e* shows a side view of two back-to-back individual layers of three dimensional material 1060, 1062 which are positioned so that the peaks or dome-shaped projections 1066 and troughs or depressions 1068 are aligned directly above or below each other. The material located between the peaks and depressions 1066, 1068 of the layers 1060, 1062 is welded together at points 1064. Welding, joining, or otherwise fastening the material together at points 1064 maintains the back-to-back alignment of the peaks and depressions 1066, 1068. It is understood that in any of the illustrated embodiments, the material may be welded as shown in FIG. 4*e*.

Figure 4F:
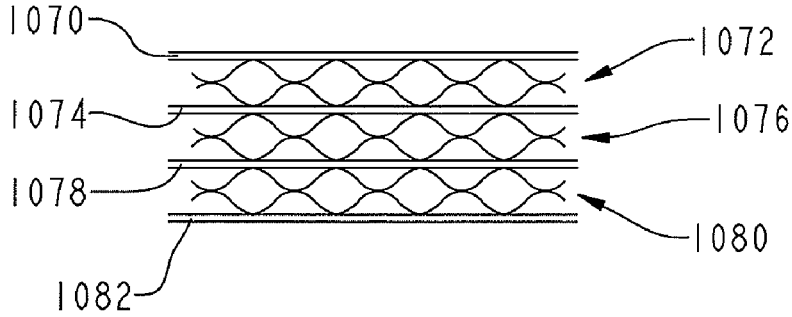
Figure 4G:
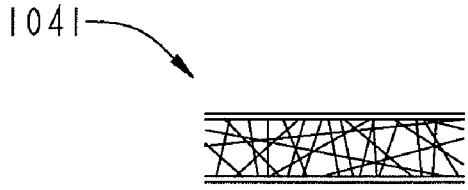
FIG. 4*g* is a side view of one embodiment of a three-dimensional spacer material.

FIG. 4*f* shows still another embodiment of the three-dimensional material located within the cover 1012 of the support surface 1010. In the embodiment of FIG. 4*f*, there are four separator layers 1070, 1074, 1078, 1082 which are each made of the three-dimensional spacer fabric discussed above. Between the first and second layers 1070, 1074 of the spacer fabric is a pair of layers 1072 of the three-dimensional material aligned back-to-back as discussed above. Located between the second and third layers 1074, 1078 of spacer fabric is a pair of individual layers 1076 of three-dimensional material aligned back-to-back as discussed above. Between the third and fourth layers 1078, 1082 of spacer fabric is another layer 1080 comprised of two back-to-back layers of three-dimensional material. In certain embodiments, the individual layers of three-dimensional material that make up each sublayer 1072, 1076, 1080 are held together by welding, plastic ties or other suitable fasteners.

In certain particular embodiments, the height of the projections and depressions of the three-dimensional material illustrated in FIGS. 4*a*-4*f* is about 3.1 mm. Also in certain embodiments, the height of three-dimensional spacer fabric 1041 illustrated in FIG. 4*g* is about 0.2 inches. Thus, in these embodiments, when two projections of three-dimensional material are positioned back-to-back, and a spacer material is used, the total height from the top of the upper projection to the bottom of the lower projection equals about 0.44 inches. In other embodiments, the three-dimensional material and spacer fabric have different dimensions and thus the layers or combination of layers have different heights.

Figure 5:
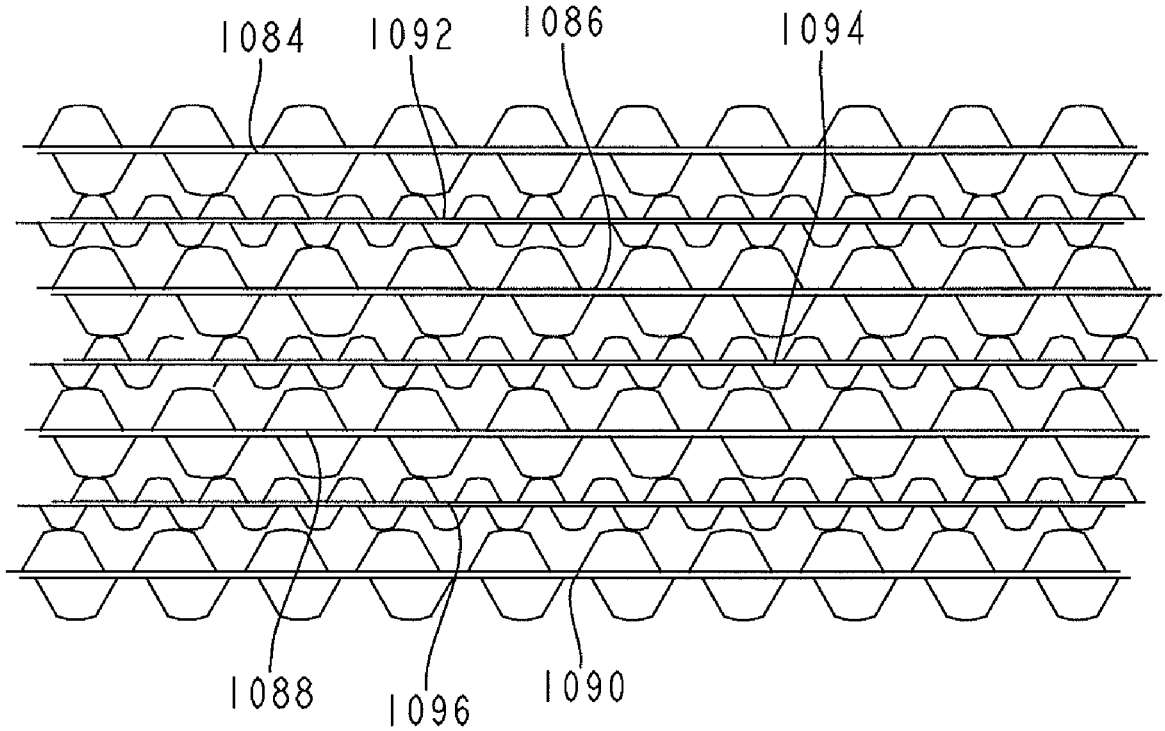
FIG. 5 illustrates another configuration of three-dimensional material including two different embodiments of three-dimensional material.

FIG. 5 shows yet another embodiment of the three-dimensional material located within the cover 1012 of the support surface 1010. In the embodiment of FIG. 5, there are four layers 1084, 1086, 1088 and 1090 of a first type or style of three-dimensional material, and three layers 1092, 1094, 1096 of a second type or style of three-dimensional material. The layers 1092, 1094, 1096 have smaller projections and depressions than the layers 1084, 1086, 1088, 1090. In other words, the projections and depressions of layers 1092, 1094, 1096 each have a diameter and/or height that is smaller than the diameter and/or height of the projections and depressions of layers 1084, 1086, 1088, 1090.

All of the layers 1084, 1086, 1088, 1090, 1092, 1094, 1096 include two individual layers of three-dimensional material positioned back-to-back, however, the projections and depressions of layers 1092, 1094, 1096 are not substantially aligned as they are in the layers 1084, 1086, 1088, 1090.

In alternative embodiments, a spacer fabric is provided in between one or more of the layers or sublayers. It is understood that, in alternative embodiments of the support surface 1010, there are varying numbers of layers and/or sublayers of three-dimensional material and spacer fabric. For example, in general, the number of layers or sublayers is between 1 and 20. In one embodiment the number of layers is 1012.

In the illustrated embodiments, the cover 1012, which defines the interior region within which the three-dimensional material is positioned to form a support surface, is made of a stretchy, breathable material such as Lycra®. It is understood that any of the illustrated embodiments of FIGS. 4*a*-4*f* may be inserted into the interior region 1014 of the cover 1012 to form the support surface 1010.

In alternative embodiments, any of the configurations shown in FIG. 4*a*-4*f* constitute one layer and multiple such layers are inserted within the interior region 1014 of the cover 1012. In certain embodiments, the support surface 1010 constitutes one layer, for example, as a "topper" or coverlet, positioned above, below, or in between one or more other layers of patient support 10. In still other embodiments, additional layers of one or more other support materials, such as foam and/or air bladders, are also included within the interior region of the cover.

Figure 6:
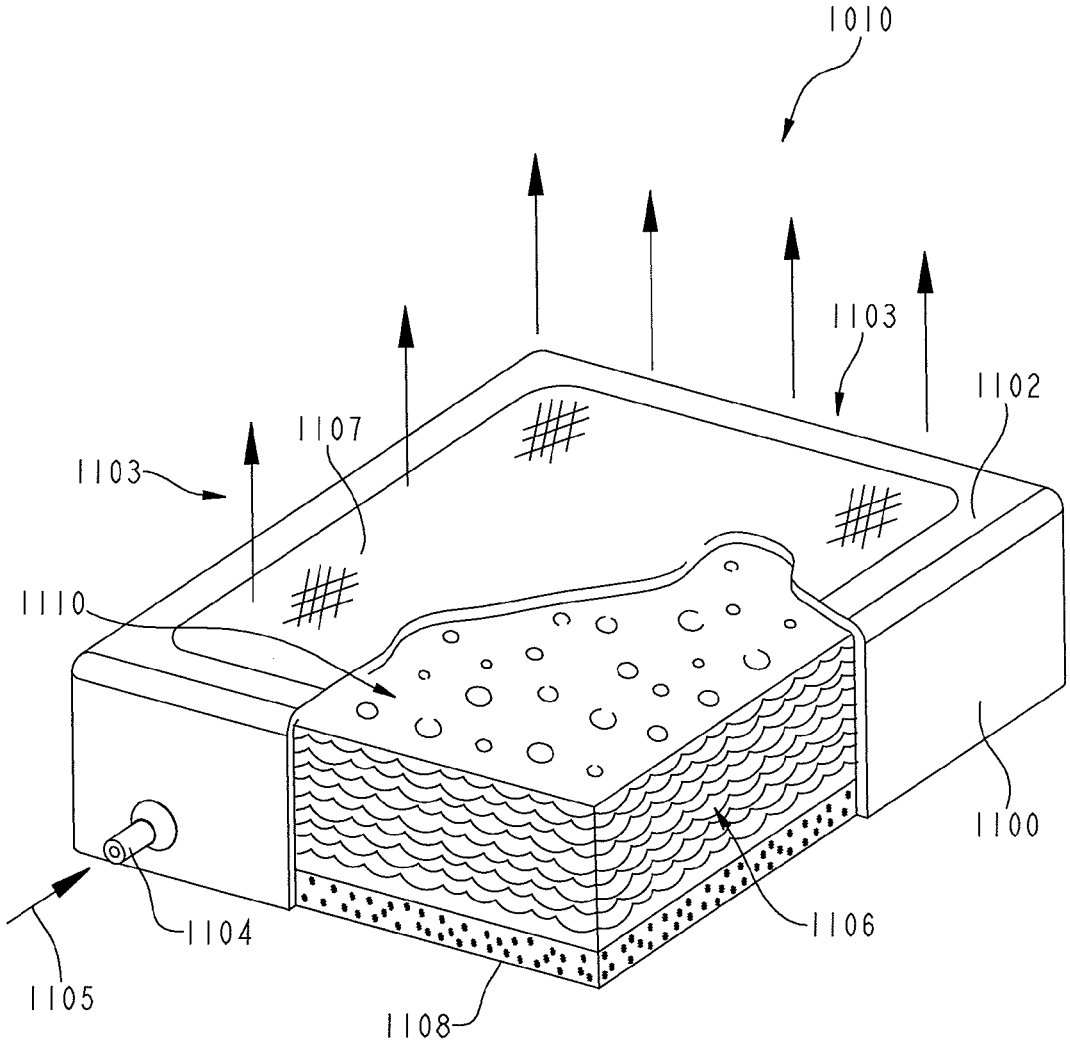
FIG. 6 illustrates a perspective view of one embodiment of a support surface including three-dimensional material and a foam base, with a portion of the cover cut away.

For example, in one embodiment, the support surface 1010 includes a three-dimensional material and a foam base. One such alternative embodiment is shown in FIG. 6. In the embodiment of FIG. 6, a cover 1100 includes a top surface 1102 and an air inlet 1104. At least a portion 1107 of the top surface 1102 is air permeable and permits air flow in the direction of arrows 1103. The air inlet 1104 is coupled to an air supply (not shown) so that air flows in the direction of arrow 1105 into the interior region 1110 of the cover 1100 through the air inlet 1104. Because at least a portion 1107 of the top surface 1102 permits air flow, the air that flows into the interior region 1110 flows through the interior region 1110 and then upwardly out through the top surface 1102.

The air circulated through the support surface is generally at ambient temperature. It is within the scope of the invention that various temperatures of air above and below the ambient temperature could be circulated. In alternative embodiments, the air is heated or cooled prior to circulation. In such embodiments, the air temperature is controlled by the patient or caregiver, or is automatically controlled in response to a measurement of the patient's temperature or surface temperature of the patient support. In still other embodiments, top surface 1102 is vapor and moisture permeable but air impermeable. The air does not exit top surface 1102 but exits through an opening or slit (not shown) in a head end 1103 of support surface 1010. In yet another embodiment, fluid is circulated through the support surface. The fluid could include water, refrigerant, gel, or any other suitable fluid for heating and cooling a patient.

A plurality of layers of three-dimensional material 1106 and a foam base 1108 are located in the interior region 1110 of the cover 1100. The plurality of layers of three-dimensional material 1106 may be configured in any of the ways shown in FIGS. 4*a*-4*f*, 5, and 9-11*b*. In the illustrated embodiments, the three-dimensional material 1106 is of the type commonly known as Spacenet. However, it is understood that other suitable three-dimensional networked fiber materials may be used.

The foam base 1108 is positioned underneath the plurality of layers of three-dimensional material 1106 within the interior region 1110 of the cover 1100. In the illustrated embodiment, the base 1108 is constructed of reticulated foam. As illustrated, the foam base 1108 has a thickness of about 1 inch. However, it is understood that other suitable thicknesses and types of foam may be used. In alternative embodiments, foam base 1108 is not included within cover 1100 or not used at all.

The embodiment of the support surface 1010 shown in FIG. 6 is thought to be particularly useful to support the area underneath a patient's heels while that patient is lying on a hospital bed, for example. The air flow through the top surface 1102 provides a cooling effect, and the resilient qualities of the three-dimensional material 1106 are configured to reduce the interface pressure between the patient's heels and the top surface 1102 of the cover 1100.

Figure 7:
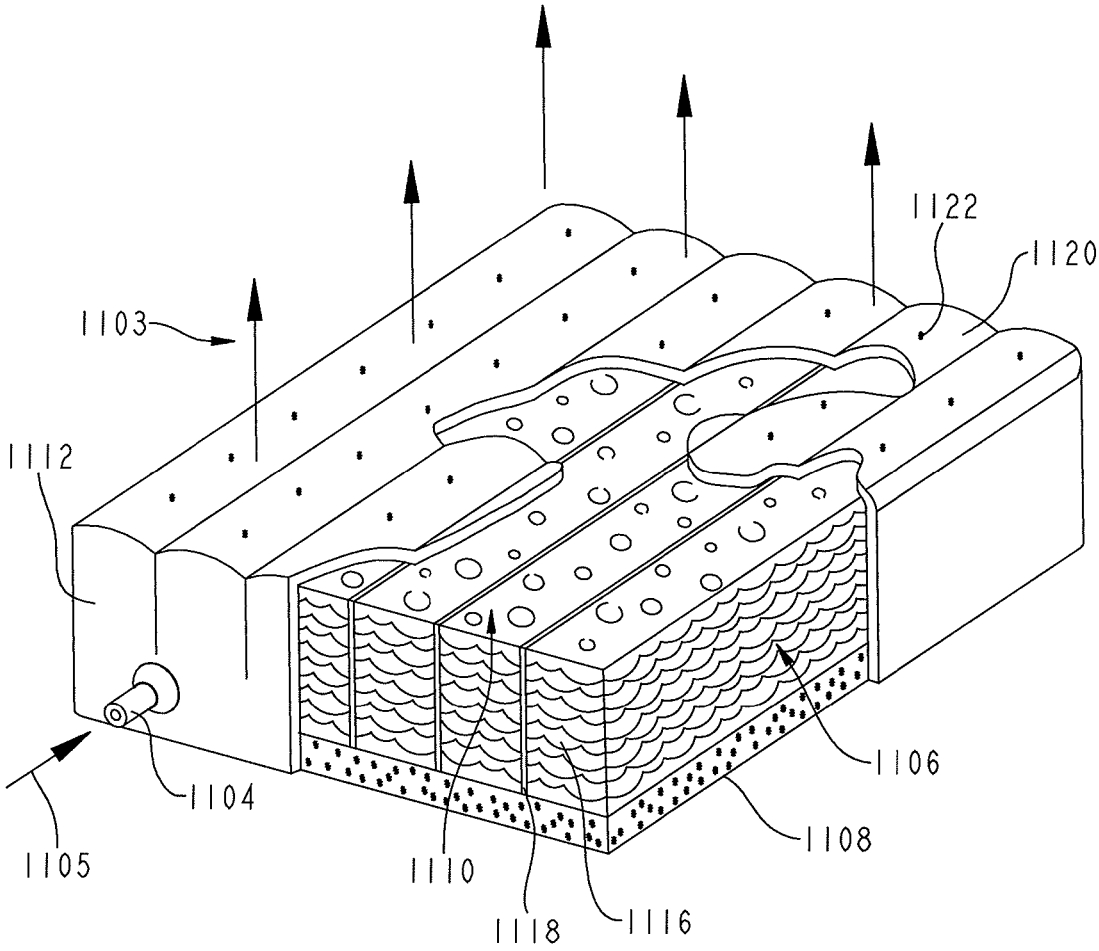
FIG. 7 illustrates a perspective view of a second embodiment of a support surface including three-dimensional material and a foam base, with a portion of the cover cut away.

The embodiment of the support surface 1110 that is shown in FIG. 7 is similar to the embodiment of FIG. 6 except that the stack of three-dimensional layers 1106 within the interior region 1110 is divided into a plurality of columns or log-shaped cells 1116. The columns 1116 are separated by channels 1118 which additionally allow air flow between the columns 1116 of three-dimensional material upwardly through the top surface 1120 of the cover 1112.

A top surface 1120 of the cover 1112 includes a plurality of pleats, valleys, indentations, or creases 1114 which generally correspond to the location of the channels 1118 within the interior region 1110. The top surface 1120 of the cover 1112 also includes a plurality of apertures 1122 which allow for air flow through the top surface 1120.

The columns 1116 of the three-dimensional material 1106 allow the three-dimensional material to move more freely in response to movement of a patient positioned on the support surface. Each individual column 1116 is movable independently of the others.

The rate of flow of the air into the interior region 1110 of the cover 1112 through the inlet 1104 can be adjusted in order to remove moisture from the interior region 1110 or from the top surface 1120 and have a drying effect on the skin of a patient or portion of a patient's body that is adjacent to the top surface 1120. Also, the rate of air flow through the inlet 1104 is adjustable. For example, it can be increased to partially or fully inflate the interior region 1110 to make the top surface 1120 firmer as may be desired, for example, for ease of transfer of the support surface or to support the patient's weight.

Still other embodiments of the support surface 1110 include a layer of three-dimensional material in combination with one or more inflatable cushions or bladders.

Figure 8:
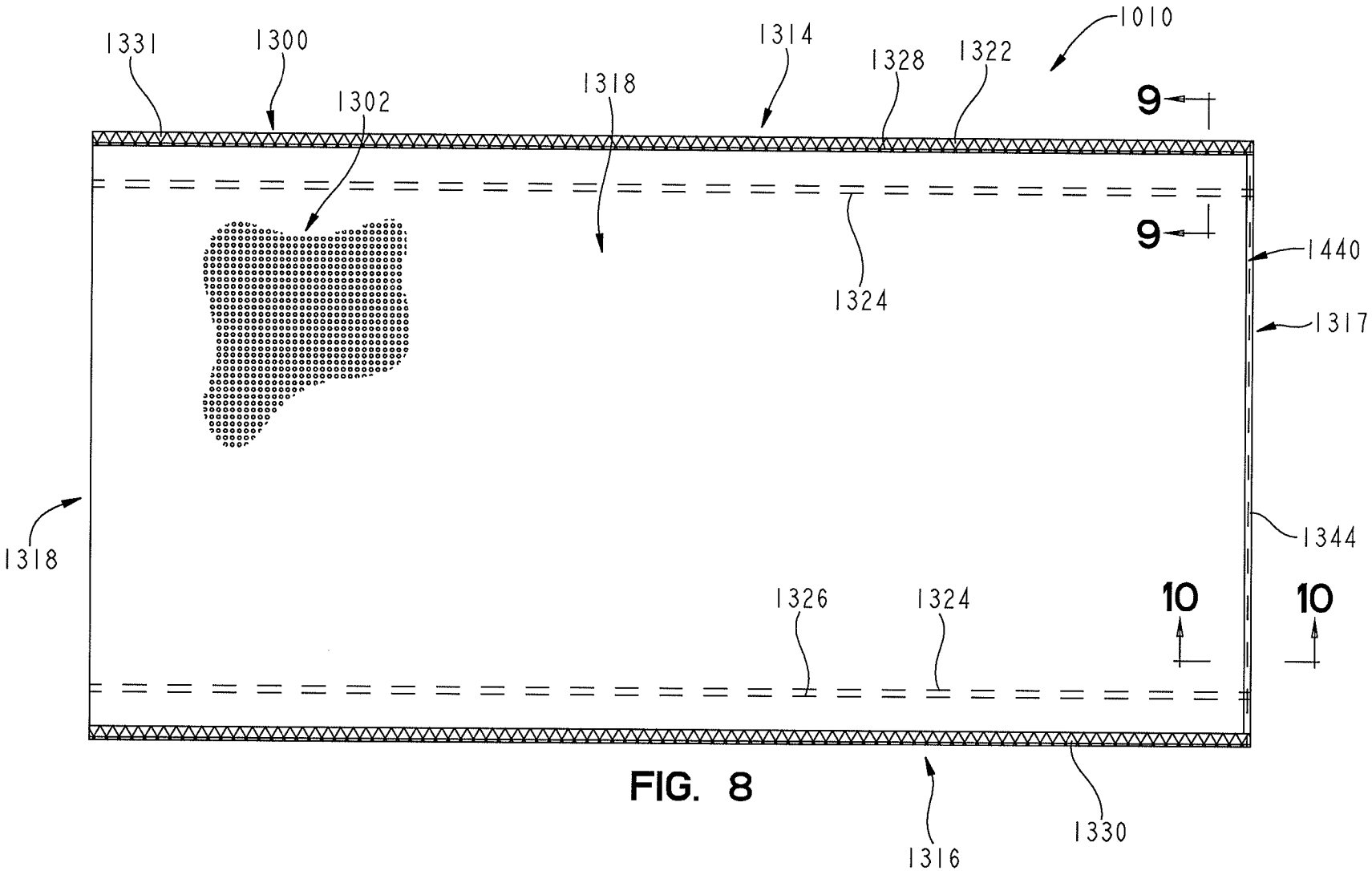
FIG. 8 is top view of another embodiment of a support surface including layers of three-dimensional material, with a portion of the cover cut-a-way.
Figure 9:
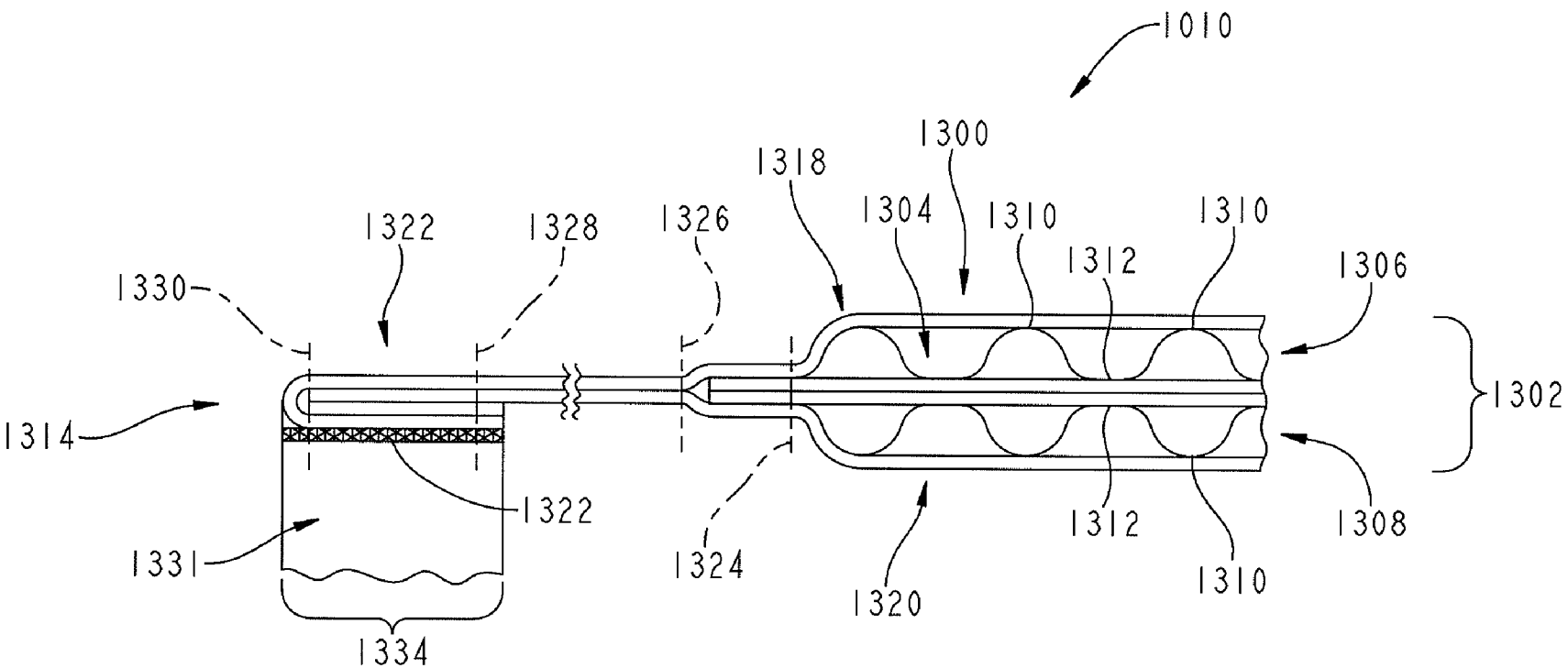
FIG. 9 is cross section of FIG. 8 along 9-9 showing the interior of the support surface.
Figure 10:
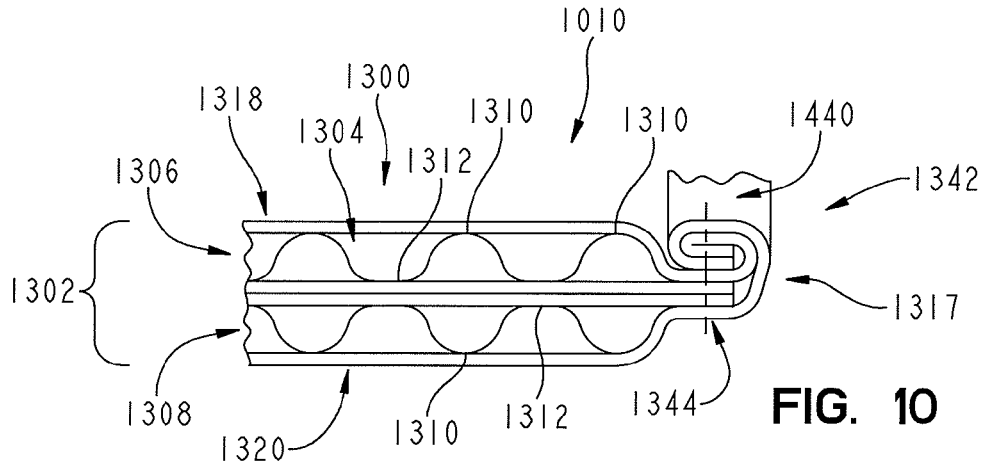
FIG. 10 is cross section of FIG. 8 along 10-10 showing the interior of the support surface.

FIGS. 8-10 show yet another embodiment of support surface 1100. Support surface 1010 includes a cover 1300 and a plurality of layers of three dimensional material 1302. Cover 1300 defines an interior region 1304, which contains the plurality of layers of three-dimensional material 1302. As illustrated in FIGS. 9 and 10, there are two individual layers or strips 1306, 1308 of the three-dimensional material provided within the interior region 1304 of the cover 1300. Each individual layer of three-dimensional material includes a plurality of peaks or substantially dome-shaped projections 1310 and troughs or depressions 1312.

Cover 1300 includes a first longitudinal side 1314, a second longitudinal side 1316, a head end 1315, a foot end 1317, an upper cover 1318, and a lower cover 1320. A loop fastener 1322 is provided allow first and second longitudinal sides 1314, 1316. Loop faster 1322 matches to a hook fastener (not shown) located on an interior surface of a patient support cover (not shown). The hook fastener and loop fastener 1322 hold cover 1300 in place within the patient support cover.

A cutaway along longitudinal side 1314 is illustrated in FIG. 9. There are two layers 1306, 1308 of three-dimensional material stacked "back-to-back", with the dome-shaped projections or peaks 1310 facing in opposite directions. The dome-shaped projections or peaks 1310 and depressions or troughs 1312, respectively, are substantially aligned.

As shown in FIG. 9, upper cover 1318 and lower cover 1320 extend beyond the two layers 1306, 1308. Upper cover 1318 and lower cover 1320 are stitched with a convention stitch at a first stitch location 1324, a second stitch location 1326, a third stitch location 1328, and a forth stitch location 1330. First stitch location is near layers 1306, 1308 and used to hold layers 1306, 1307 within cover 1300. Second stitch location 1326 is provided to reinforce first stitch location 1324. Upper and lower covers 1318, 1320 define a folded region 1331 near an end 1332 of upper cover 1318 and lower cover 1320. Stitching through folded region 1331 occurs at third and fourth stitch locations 1328, 1330. Additionally, a hem 1334 covers the entire folded region 1331. Hoop fastener 1322 is held in place by hem 1334. In alternative embodiments, upper cover 1318 and lower cover 1320 are RF Welded at the stitch and hem locations.

A cutaway along foot end 1317 is illustrated in FIG. 10. Upper and lower covers 1318, 1320 define a folded region 1340 near an end 1342 of upper and lower covers 1318, 1320. Stitching through folded region 1340 occurs at fifth stitch location 1344. A stitch or hem goes through folded region 1340. Folded region 1340 includes a portion of layers 1306, 1308 and a portion of upper and lower covers 1318, 1320.

Figure 11A:
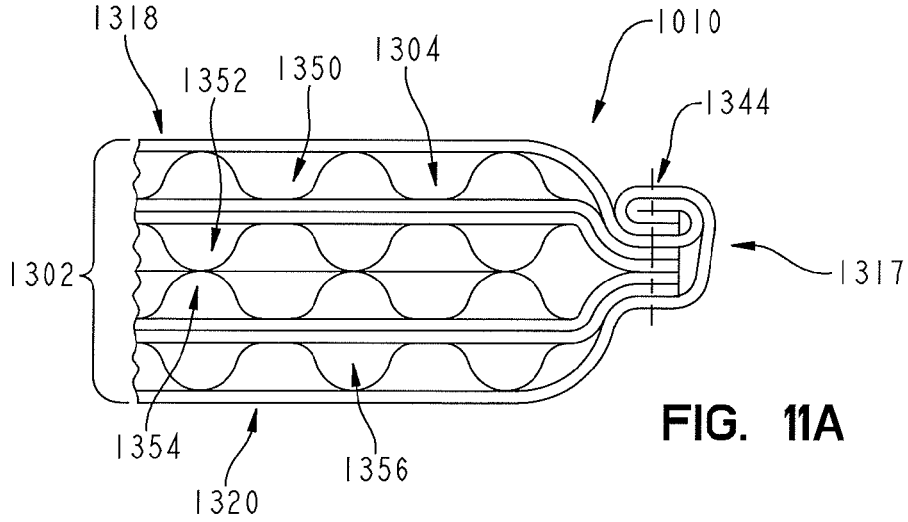
FIGS. 11*a*-11*b* illustrate side views of various configurations of a three-dimensional material similar to those in FIG. 8.
Figure 11B:
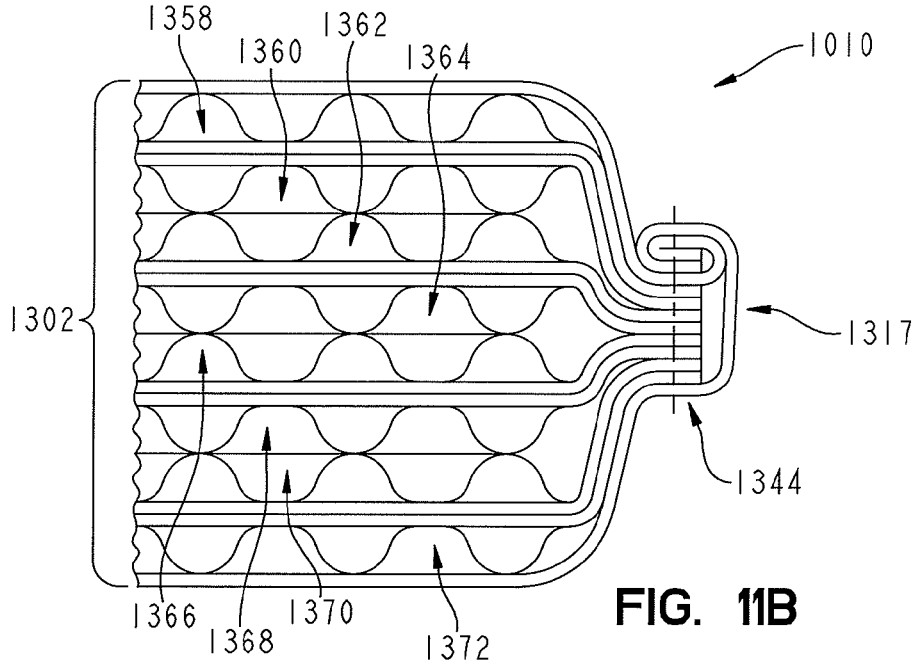

FIGS. 11A and 11B show alternative embodiments of support surface 1010 that are similar to those in FIGS. 8-10. FIG. 11A shows four individual layers or strips 1350, 1352, 1354, 1356 of the three-dimensional material provided within the interior region 1304 of the cover 1300. FIG. 11B shows eight individual layers or strips 1358, 1360, 1362, 1364, 1366, 1368, 1370, 1372 of the three-dimensional material provided within the interior region 1304 of the cover 1300. In alternative embodiments, any number of layers of three-dimensional material may be used. Layers of different thickness and support characteristics could also be used. Additionally, a layer of material similar to that of the cover could be provide between each layer of three-dimensional material or between groups of layers of three-dimensional material.

As discussed above, the three-dimensional material used in certain embodiments of the support surface 1010 is generally enclosed in a cover. In embodiments of the support surface 1010 that include more than one layer of support (i.e., three-dimensional material and air bladders), an outer cover or ticking is used to enclose all of the internal layers of the support surface within an interior region.

The outer covering or ticking may be provided in addition to or in place of the cover surrounding the three-dimensional material, described above. Typically, a zipper or other suitable fastener is provided to couple two halves of the outer cover together around the support surface layers.

In general, the outer cover or ticking is made of a moisture resistant material, such as plastic or a plastic-coated material. In one particular embodiment, a urethane-coated fabric is used.

In certain embodiments, all or a portion of the outer ticking is made of a low air loss plastic or plastic-coated material, or is otherwise breathable. Alternatively or in addition, the outer ticking may be coated with a low friction material such as Teflon® to reduce sheer between the patient and the support surface. Also, the outer ticking or portions thereof may be treated with chemicals, ozone or ions so that it is bacteria resistant. Further, all or portions of the outer ticking surface may be treated or otherwise designed to resist staining, for example, using a patterned tick.

The outer ticking is generally designed to prevent fluid ingress through the use of sealed ticking or wicking channels. Also, in certain embodiments the outer ticking is designed to be disposable or replaceable.

In other embodiments, the outer cover or ticking is made of a moisture and vapor permeable but air impermeable layer. These materials are typically covered with either a Teflon® coating or a Urethane coating.

These features of the outer ticking are designed primarily to minimize the amount of maintenance required to properly care for and maintain the condition of the outer ticking and the support layers within.

The outer ticking is also configured to improve the user friendliness of the support surface 1010. For example, instructions for the caregiver with regard to appropriate installation and use of the support surface 1010 are applied to the top surface or other plainly visible areas of the outer ticking. For example, indications, icons, symbols, or distinct color coding schemes may be used to guide the caregiver through proper installation and use. Alignment decals and/or an outline of the proper orientation of a patient on the surface are also provided in certain embodiments.

Although the invention has been described in detail with reference to certain illustrated embodiments, variations and modifications exist within the scope and spirit of the present invention as defined by the following claims.

The invention claimed is:

1. A mattress, comprising:

a non-rigid base having a head end configured to support a person's head, a foot end longitudinally spaced from the head end and configured to support a person's feet, a first side, and a second side laterally spaced from the first side, a single layer of spaced-apart vertically-oriented inflatable bladders supported by the base, arranged into columns extending along the length of the base and arranged into rows extending from the first side to the second side of the base, each bladder comprising a bottom end, a vertical portion extending upwardly from the base and a top end supported substantially by the vertical portion, each bladder being fixed at only one of the top and bottom ends, a first grouping of rows and columns comprising bladders all being of substantially the same height, and a second grouping of rows and columns comprising bladders all being of substantially the same height, the bladders being spaced from each other by an unfilled region, a support layer located above the plurality of vertically-oriented inflatable bladders, the support layer including an air permeable three-dimensional material configured to provide cushioning for a patient positioned on the mattress and circulate air underneath the patient positioned on the mattress, and a moisture/vapor permeable material included in the support layer, wherein the foot end includes a height that is shorter than a height of the head end.

2. The mattress of claim 1, wherein the three dimensional material comprises resilient fibers and air channels between the resilient fibers.

3. The mattress of claim 1, wherein each of the bladders is attached to the non-rigid base.

4. The mattress of claim 1, wherein the single layer of inflatable bladders comprises a first bladder assembly including a first plurality of rows and columns of vertically-oriented bladders, a second bladder assembly longitudinally spaced from the first bladder assembly and including a second plurality of rows and columns of vertically-oriented bladders, and a third bladder assembly longitudinally spaced from the second bladder assembly and including a third plurality of rows and columns of vertically-oriented bladders, wherein each of the first, second, and third bladder assemblies are connected to the non-rigid base.

5. The mattress of claim 1, wherein the support layer includes a low-friction material configured to allow the support layer to move with movement of a patient positioned on the mattress.

6. A mattress, comprising:

a non-rigid base, first, second and third longitudinally spaced zones, each zone being configured to support a different portion of a person laying in a horizontal position and each zone comprising a single layer of rows of spaced-apart inflatable bladders extending across the width of the base and columns of spaced-apart inflatable bladders extending along the length of the zone, the bladders being spaced from each other by an unfilled region, each of the bladders being coupled to and supported by the base and fixed at only one end, each of the bladders of each of the zones having a vertical portion extending upwardly from the base and a top portion supported substantially by the base and spaced from the base by a height of the vertical portion, all of the bladders of the first zone having a first vertical height, all of the bladders of the second zone having a second vertical height, and all of the bladders of the third zone having a third vertical height, wherein the third zone includes a height that is shorter than a height of the first zone, and a support layer including an air permeable three-dimensional material located above the first, second and third zones and a vapor permeable material adjacent the air permeable three-dimensional material.

7. The mattress of claim 6, comprising an air inlet coupled to the first, second, and third zones.

8. The mattress of claim 6, comprising a cover having a bacteria-resistant top surface.

9. The mattress of claim 8, wherein the top surface of the cover is stain-resistant.

10. The mattress of claim 8, wherein the top surface of the cover is fluid-impermeable.

11. The mattress of claim 6, wherein the second vertical height and the first vertical height are substantially the same.

12. A mattress, comprising:

a non-rigid base having a head end and a foot end longitudinally spaced from the head end, a head section bladder assembly attached to a head section of the base, the head section bladder assembly being located proximate the head end of the base and configured to support at least a head portion of a person, the head section bladder assembly comprising a a single layer of vertically-oriented inflatable bladders, the vertically-oriented bladders being arranged into rows across a width of the head section bladder assembly and being arranged into columns down a length of the head section bladder assembly, each of the bladders having a first bottom end, a first vertical portion extending upwardly from the base, a first top end supported substantially by the first vertical portion, and all of the bladders of the head section bladder assembly having a first vertical height extending between the base and the, first top end, each of the bladders being fixed at only one of the first top and bottom ends, the bladders being spaced from each other by an unfilled region, a seat section bladder assembly attached to a seat section of the base and spaced from the foot end of the base, the seat section bladder assembly comprising a a single layer of vertically-oriented inflatable bladders, the vertically-oriented bladders being arranged into rows across a width of the seat section bladder assembly and being arranged into columns down a length of the seat section bladder assembly, each of the bladders having a second bottom end, a second vertical portion extending upwardly from the base, a second top end supported substantially by the second vertical portion, and all of the bladders of the seat section bladder assembly having a second vertical height extending between the base and the, second top end, each of the bladders being fixed at only one of the second top and bottom ends, the bladders being spaced from each other by an unfilled region, a foot section bladder assembly attached to a foot section of the base located proximate the foot end of the base and configured to support at least a foot portion of a person, the foot section bladder assembly comprising a single layer of vertically-oriented inflatable bladders, the vertically-oriented bladders being arranged into rows across a width of the foot section bladder assembly and being arranged into columns down a length of the foot section bladder assembly, each of the bladders having a third bottom end, a third vertical portion extending upwardly from the base, a third top end supported substantially by the third vertical portion, and all of the bladders of the foot section bladder assembly having a third vertical height extending between the base and the, third top end, each of the bladders being fixed at only one of the third top and bottom ends, the bladders being spaced from each other by an unfilled region, a support layer extending from the head end of the base to the foot end of the base and including an air-permeable three-dimensional material supported by the first top portion of the bladders of the head section bladder assembly and supported by the second top portion of the bladders of the seat section bladder assembly and supported by the third top portion of the bladders of the foot section bladder assembly, and a moisture/vapor permeable material included in the support layer, wherein at least one bladder of the foot section bladder assembly has a third vertical height that is smaller than the second vertical height of the bladders of the seat section bladder assembly and the third vertical height is smaller than the first vertical height of the bladders of the head section bladder assembly.

13. The mattress of claim 12, wherein each of the head section bladder assembly and the seat section bladder assembly has a width extending transversely across the base, and the width of the head section bladder assembly is substantially the same as the width of the seat section bladder assembly.

14. The mattress of claim 12, wherein each of the head section bladder assembly and the seat section bladder assembly has a length extending longitudinally along the length of the base, the length of the head section bladder assembly substantially corresponds to a length of an articulating head section of a deck of a hospital bed, the length of the seat section bladder assembly substantially corresponds to a length of a seat section of the articulating deck of the hospital bed, and the length of the foot section bladder assembly substantially corresponds to a length of an articulating foot section of the deck of the hospital bed.

15. The mattress of claim 12, comprising an air inlet coupled to the base.

16. The mattress of claim 12, comprising a plurality of couplers to secure the mattress to an articulating deck of a hospital bed.

17. The mattress of claim 16, wherein the first vertical height of the bladders of the head section bladder assembly is substantially the same as the second vertical height of the bladders of the seat section bladder assembly.

18. The mattress of claim 12, wherein the support layer includes a low friction material.

* * * * *